US008485116B2

(12) United States Patent
Baylot et al.

(10) Patent No.: US 8,485,116 B2
(45) Date of Patent: Jul. 16, 2013

(54) FLOATING SUPPORT FITTED WITH A TURRET INCLUDING ROLLING BEARINGS PROTECTED FROM WATER

(75) Inventors: Michel Baylot, Marseilles (FR); Jean-Paul Denise, Hyères (FR); Thomas Marty, Aix en Provence (FR)

(73) Assignee: Saipem S.A., Montigny le Bretonneux (FR)

( * ) Notice: Subject to any disclaimer, the term of this patent is extended or adjusted under 35 U.S.C. 154(b) by 379 days.

(21) Appl. No.: 12/933,778

(22) PCT Filed: Mar. 18, 2009

(86) PCT No.: PCT/FR2009/050453

§ 371 (c)(1), (2), (4) Date: Sep. 21, 2010

(87) PCT Pub. No.: WO2009/122098

PCT Pub. Date: Oct. 8, 2009

(65) Prior Publication Data

US 2011/0017117 A1 Jan. 27, 2011

(30) Foreign Application Priority Data

Mar. 21, 2008 (FR) ..... 08 51832

(51) Int. Cl.
*B63B 21/50* (2006.01)
*B63B 22/02* (2006.01)

(52) U.S. Cl.
USPC ..... 114/230.12; 114/230.13; 44/3; 44/5

(58) Field of Classification Search
USPC ..... 114/230.1, 230.12–230.14, 293; 441/3–5
See application file for complete search history.

(56) References Cited

U.S. PATENT DOCUMENTS 3,440,671 A * 4/1969 Smulders ..... 441/5
4,571,125 A * 2/1986 Oshima et al. ..... 405/224

(Continued)

FOREIGN PATENT DOCUMENTS

| | | |
|---|---|---|
| EP | 0259072 | 3/1988 |
| GB | 2 291 391 | 1/1996 |
| GB | 2291389 | 1/1996 |
| WO | WO2007/127531 | 11/2007 |

OTHER PUBLICATIONS

International Search Report dated Nov. 13, 2009.

*Primary Examiner* — Ajay Vasudeva
(74) *Attorney, Agent, or Firm* — Cozen O'Connor

(57) ABSTRACT

An oil production floating support including a disconnectable mooring system for anchor lines to the sea bottom and for bottom-to-surface connection pipes. The floating support comprises a mooring buoy for mooring lines and bottom-to-surface connection pipes, the buoy preferably being an annular buoy. The floating support being characterized in that said turret has a watertight tubular outer structure having a bottom wall assembled in watertight manner to the bottom end of the watertight tubular outer structure. The tubular outer structure contains an inner structure secured at its top end to the hull. The inner and outer tubular structures co-operate with at least one bottom rolling or friction bearing, enabling the inner structure to turn, with the outer structure not being caused to turn when the floating support is caused to turn about a vertical axis ZZ' of the cavity and of the watertight tubular outer structure. The bottom rolling or friction bearing being situated beneath the surface of the water, but inside said watertight outer structure.

10 Claims, 4 Drawing Sheets

U.S. PATENT DOCUMENTS 4,604,961 A 8/1986 Ortloff et al.
5,170,737 A * 12/1992 Poldervaart ..... 114/293
6,014,939 A * 1/2000 Gusmeri et al. ..... 114/230.12
6,302,048 B1 * 10/2001 Smedal ..... 114/230.12

* cited by examiner

FLOATING SUPPORT FITTED WITH A TURRET INCLUDING ROLLING BEARINGS PROTECTED FROM WATER

PRIORITY CLAIM

This is a U.S. national stage of application No. PCT/FR2009/050453, filed on Mar. 18, 2009. Priority is claimed on the following application: France Application No. 0851832 Filed on Mar. 21, 2008, the content of which is incorporated here by reference.

FIELD OF THE INVENTION

The present invention relates to a floating support anchored to a disconnectable turret.

The technical field of the invention is more particularly the field of off-shore oil production in regions presenting extreme ocean and weather conditions, and in particular in Arctic or Antarctic regions, and working from floating supports.

BACKGROUND OF THE INVENTION

In general, an oil production floating support has anchor means to enable it to remain in position in spite of the effects of currents, winds, and swell. It also generally includes drilling means, oil storage means, and oil processing means, together with means for off-loading to off-loading tankers, which tankers call at regular intervals to take away the production. Such floating supports or ships are conventionally referred to as floating production storage off-loading (FPSO) vessels or indeed as floating drilling & production units (FDPU) when the floating support is also used for performing drilling operations with wells that are deflected in the depth of the water. The abbreviation FPSO is used below.

When weather and sea conditions, i.e. swell, wind, and current are severe or even extreme, as during storms, it is preferred to anchor the FPSO via a turret, generally situated in known manner in the front half of the ship and on its axis, with the ship being free to turn about said turret under the effect of the wind, current, and swell. Thus, with wind, current, and swell exerting specific forces on the hull and the superstructures, the FPSO makes use of its freedom to turn about the vertical axis ZZ so as to put itself naturally in a position of least resistance. The pipes connecting it with the well heads are generally connected to the underside of the turret and they are connected to the FPSO via a rotary joint lying on the axis of said turret. When weather conditions might become extreme, as in the North Sea, in the Gulf of Mexico, or in the Arctic or the Antarctic, the FPSO is generally disconnectable so as to be capable of taking shelter and waiting for acceptable operating conditions to return.

The present invention relates more particularly to a floating support for off-shore oil production in the Arctic or the Antarctic, the support being fitted under its hull with a disconnectable turret from where there extend anchor lines connected to the sea bottom and bottom-to-surface connection pipes, said hull including in its longitudinal direction substantially plane sides that extend vertically, and possibly also in conventional manner bow and stern portions (at the front and rear ends of the ship) that are inclined relative to the horizontal and that are preferably shaped so as to form a reinforced pointed stem capable of breaking pack ice merely by bending it whenever said pack ice forces it way under said reinforced stem.

Floating supports advantageously present a hull with substantially vertical longitudinal sides in order to optimize their oil storage capacities, and also to obtain better behavior in heavy sea. However a hull with vertical sides is particularly disadvantageous in terms of behavior relative to pack ice. Thus, in U.S. Pat. No. 4,102,288 and U.S. Pat. No. 4,571,125, floating supports are proposed that present, amongst other means, sides with profiles that are curved or inclined so as to enhance ice breaking in the manner that is known for a ship's bow having a stem that slopes relative to the horizontal.

In known manner, an oil production floating support including a releasable mooring system of anchor lines anchored to the sea bottom and of bottom-to-surface connection pipes comprises:

- a mooring buoy for said lines and bottom-to-surface connection pipes, said buoy preferably being an annular buoy; and
- said mooring buoy being fastened under the hull of the floating support to a rotary device having a tower-shaped structure referred to as a "turret", said turret being fastened to the hull within a cavity passing through the entire height of the hull of the floating support, said turret being rotatably mounted relative to said hull via at least one rolling or friction bearing, preferably a rolling bearing, so as to allow said floating support to turn about a substantially vertical axis ZZ' of said turret and of said cavity without causing said mooring buoy to turn relative to the same vertical axis ZZ'; and
- said bottom-to-surface connection pipes rise within the cavity to a coupling for a plurality of said pipes, said coupling being secured to the floating support level with the deck of the floating support, said coupling being ratably mounted so as to allow said floating support to turn without turning said coupling that is referred to as a rotary joint coupling.

In the above-described prior art, the rolling bearing is located either level with the deck of the floating support, or else in the bottom portion under water, i.e. the bearing is immersed, or indeed a combination of the above two configurations may be used.

Embodiments in which the rolling bearing is located solely level with the deck are suitable only for floating supports of relatively small height, in particular less than 15 meters (m). With greater heights, for floating supports having a height lying in the range 20 m to 25 m, in particular, the horizontal force on the turret resulting from the floating support turning gives rise to the structure of the turret bending along its length, thereby mechanically stressing the top rolling bearing and thus mechanically endangering its reliability of operation. Furthermore, when the rolling bearing is underwater in the bottom portion of the turret, this immersion affects the operating reliability and the durability of said rolling bearing, and above all gives rise to difficulties in performing maintenance operations. On-site action requires the use of divers and of considerable technical means, and it is generally necessary to perform such operations in a protected zone, such as a fjord, or better still in a dry dock, after the FPSO has been disconnected. Thus, when an FPSO is intended to remain in position for several tens of years without any programmed maintenance disconnections in dry dock or in a protected site, that type of turret is not suitable.

Supports of the above-defined type are known from GB 2 291 389, EP 0 259 072, and U.S. Pat. No. 4,604,961.

SUMMARY OF THE INVENTION

The object of the present invention is to provide a novel floating support of the above-defined type with a disconnectable mooring system that includes an improved rotary turret, and more particularly one in which reliability and maintenance of the rolling bearings used for enabling the turret to turn relative to the floating support is improved, in particular by being simpler and less expensive to perform and to implement.

To do this, the present invention provides an oil production floating support including a disconnectable mooring system for anchor lines anchored to the sea bottom and for bottom-to-surface connection pipes, the floating support comprising:

a mooring buoy for said anchor lines and first bottom-to-surface connection pipes extending from said buoy, to which they are moored, down to the bottom of the sea, said buoy preferably being an annular buoy; and a turret extending in a through cavity passing along the entire height of the hull of the floating support, said mooring buoy being fastened under the hull of the floating support to said turret, said turret co-operating with the hull within said through cavity passing along the entire height of the hull of the floating support, said turret being rotatably mounted relative to said hull via at least one rolling or friction bearing, and preferably via a rolling bearing, so as to allow said floating support to turn about a substantially vertical axis ZZ' of said turret and of said cavity without causing said mooring buoy to turn relative to the same vertical axis ZZ'; and second connection pipes between the top ends of said first bottom-to-surface connection pipes and the deck of the floating support, the second pipes rising within the cavity to a coupling for a plurality of said second pipes, said coupling being secured to the floating support, preferably level with the deck of the floating support, said coupling being of the rotary joint coupling type and being rotatably mounted so as to allow said floating support to turn without turning said coupling.

According to the present invention, said turret comprises:

a watertight tubular outer structure about the same vertical axis ZZ', preferably of circular section, having a bottom wall assembled in watertight manner to the bottom end of said watertight tubular outer structure;

said tubular outer structure containing an inner structure, preferably a tubular inner structure of circular section coaxial with said tubular outer structure, the top end of said inner structure being secured to the hull;

said bottom wall of the watertight outer structure having a plurality of said pipes passing therethrough in leaktight manner, which pipes pass through and are supported by said inner structure;

said watertight outer structure not being supported by said hull nor being fastened to said hull, and having dimensions that enable it to float naturally in the water in the cavity in said floating support;

said inner and outer tubular structures co-operating with at least one bottom rolling or friction bearing, preferably a rolling bearing, allowing said inner structure to turn, said outer structure being prevented from turning when said floating support is caused to turn about said vertical axis ZZ' of the cavity and of said watertight tubular outer structure; and said bottom rolling or friction bearing being situated below the surface of the water but inside said watertight outer structure.

This configuration for the mooring system and the rolling or friction bearing in accordance with the present invention is particularly advantageous compared with the prior art, since said rolling bearing is in the dry and is accessible from inside the inner and/or outer structures without it being necessary to work under water, with this applying both to the personnel involved and to the equipment. By way of example, rolling means may thus be maintained easily, in particular they may be greased regularly, thereby greatly reducing friction and making it easier for the FPSO to turn about its turret. In addition, rolling elements may easily be changed under all conditions, in particular even during a storm and not only in calm weather.

In a preferred embodiment, said floating support includes at least one "support" bottom rolling bearing interposed between the bottom wall of said watertight tubular outer structure and the bottom end of said inner structure.

It can be understood that said rolling bearing is situated above said bottom of the turret and below said inner structure.

It can be understood that when said inner structure is constituted by a tubular structure of circular section at its bottom end, said bearing is interposed between said bottom of the outer structure and the circular edge face at the circular section bottom end of said inner structure.

Also preferably, said floating support includes:

at least one bottom "guide" lateral rolling bearing interposed between the inner side surface of said outer tubular structure and the outer side surface of said inner structure, said bottom lateral guide bearing being situated below the level of the water surface and closer to said bottom wall of said tubular outer structure than to the top end of said tubular outer structure, preferably in the vicinity of said bottom wall; and at least one top "guide" lateral rolling bearing interposed between the inner side surface of the outer tubular structure and the outer surface of said inner structure, said bearing being situated closer to the top end of said tubular outer structure than to the bottom of said tubular outer structure, preferably in the vicinity of the top end of the inner structure.

In a particular embodiment, said rolling bearing(s) is/are constituted by rollers or by wheels.

It can be understood that said rollers or wheels are disposed with their axes of rotation in a substantially vertical position interposed between said inner and outer structures for said top and bottom lateral guide bearings; and for said bottom support bearing, said rollers or wheels are disposed with their axes of rotation in substantially horizontal positions.

More particularly, said rollers or wheels are disposed circularly around said inner structure, preferably being regularly spaced apart circularly in the annular space between said inner and outer structures, and preferably being regularly spaced apart on said bottom of the outer structure, being disposed in a circle.

Advantageously, said outer and inner tubular structures include abutment means and retaining means preventing said outer structure from sinking in the event of sea water accidentally flooding the inside of the outer tubular structure due to loss of watertightness, said abutment means and said retaining means enabling the outer structure to be retained by said inner structure.

It can be understood that since said inner structure is held securely to the hull by bearing thereon at its top end, said retaining means prevent said outer structure from dropping below said floating support.

In a particular embodiment, said inner structure includes at its top end a top peripheral plate via which said inner structure is secured to the hull of said floating support, preferably said top face bearing via a step in the top end of said cavity, more preferably in such a manner that said top plate does not project above the level of the deck of the floating support.

Still more particularly, said top plate bears against a step in the top end of said cavity, preferably in such a manner that said top plate does not project above the level of the deck of the floating support.

Advantageously, said inner structure contains a carrier structure, preferably in the form of a central pillar, preferably of circular section, that rests on the bottom wall of said tubular outer structure and that extends up to the level of the deck of the floating support, said carrier structure holding said second pipes passing through the inner structure in a supported position, and preferably also supporting said rotary joint coupling resting on top of said carrier structure level with the deck of the floating support.

In a particular and advantageous embodiment of the invention, said buoy includes a top tubular wall, preferably of circular section, defining a "valve" chamber when the top edge of the tubular top wall of the buoy is pressed against the bottom wall of the turret, said valve chamber containing the top ends of said first pipes passing through the bottom wall of said valve chamber, the top ends of said first pipes being fitted with vales and/or with male or female automatic connector portions supported by said bottom wall of the valve chamber, and said buoy including in its bottom portion an annular box constituting a float under the bottom wall of the valve chamber.

BRIEF DESCRIPTION OF THE DRAWINGS

Other aspects of the problem and other characteristics and advantages of the present invention appear more clearly in the light of the following detailed description made in illustrative and non-limiting manner with reference to the drawings, in which.

DETAILED DESCRIPTION OF THE PRESENTLY PREFERRED EMBODIMENTS

Figure 1:
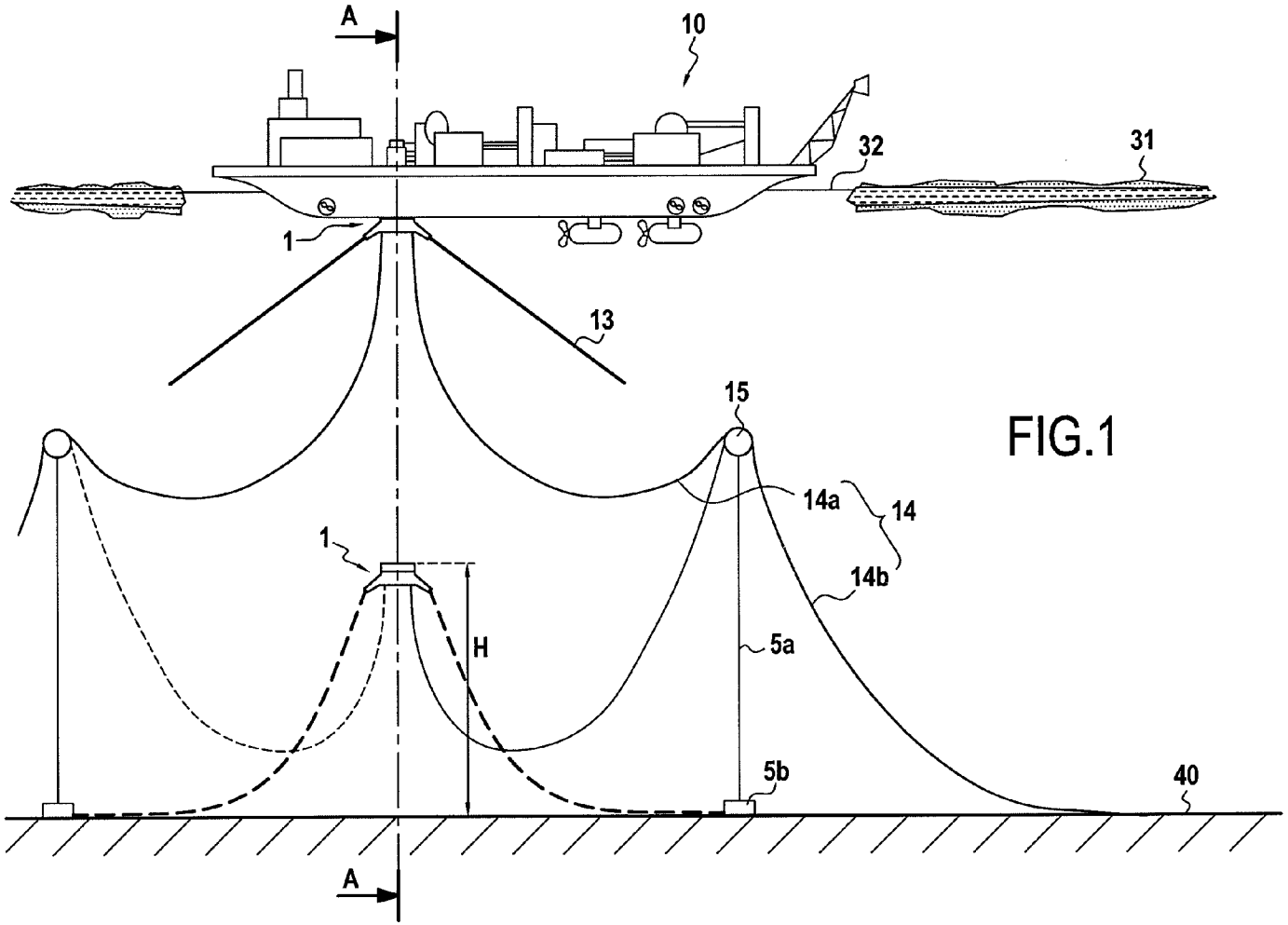
FIG. 1 is a side view in section of an FPSO anchored on a turret within pack ice.

FIG. 1 is a side view in section showing a ship or floating support of the FPSO type 10 anchored on a turret of a releasable mooring system 1 anchored by anchor lines 13 and connected to undersea well heads (not shown) via flexible pipes 14 in a dipping catenary configuration 14*a* going down to a subsurface float 15 supporting said pipe, said float being held by a cable 5*a* connected to a mooring block or "deadman" 5*b* at the bottom of the sea, after which said flexible pipe 14*a* extends in a catenary configuration 14*b* down to the bottom of the sea 40 and then to said well heads. The FPSO is in cold water in which icebergs or pack ice 31 of large area and considerable thickness can be present floating on the surface of the sea 32. In certain extreme conditions, such as storms or when the pack ice is so thick that the ice breaker-shaped bow of the ship cannot break it as it advances, it is necessary to disconnect the FPSO to allow it to take shelter while waiting for the situation to return to normal. For this purpose, the bottom portion 1 of the mooring system, commonly referred to as a "spider buoy" is constituted by an annular mooring buoy 1 that can be disconnected in a manner known to the person skilled in the art, generally from the bottom of the FASO, thereby enabling said FPSO to be released so that it can take shelter. More particularly, the mooring buoy 1 and the first underwater pipes 14 are connected to said bottom wall 2*c* of the turret via the bottom face of the bottom wall 2*c* by means of automatic connectors 7. The internal buoyancy of the annular mooring buoy 1 is adjusted in such a manner that said buoy stabilizes at a height H above the bottom of the sea, e.g. corresponding to a distance of 100 m from the surface of the sea 32, thereby putting all of the anchor lines and pipes in a sheltered position, as also shown in FIG. 1.

Figure 3B:
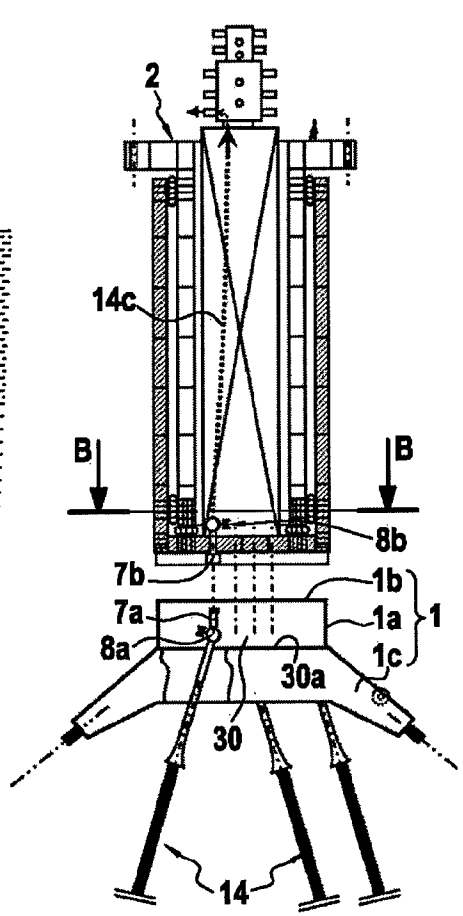
FIG. 3B shows the mooring buoy being cast off to allow the FPSO to take shelter.
Figure 3A:
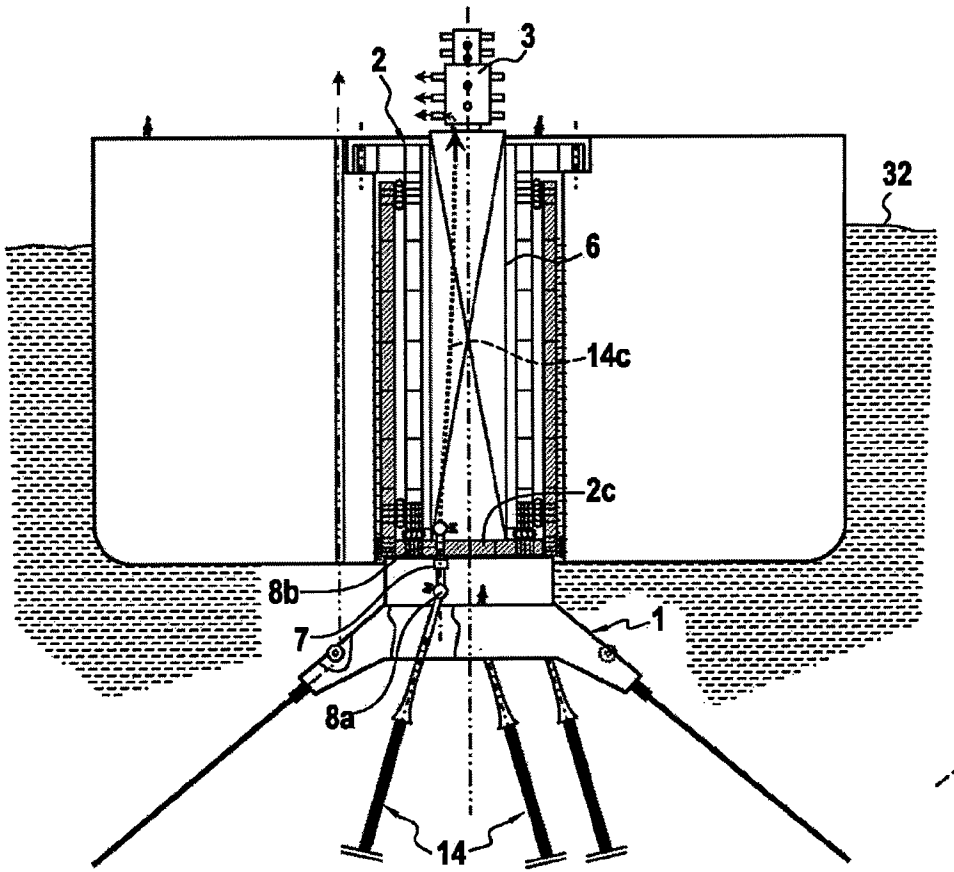
FIG. 3A is a section view on plane AA of FIG. 1 showing the FPSO and the turret of the invention in section with the mooring system including the turret of the invention, the mooring buoy supporting the anchor lines and the flexible pipes, said buoy being connected to the base of the turret with a rotary joint coupling (3) level with the deck of the floating support.

In FIGS. 3A and 3B, there can be seen the entire disconnectable mooring system 1 of the present invention including an annular mooring buoy 1:

said mooring buoy is fastened under the hull of the floating support, at the bottom face of the bottom wall 2*c* of the turret 2, said turret extending over the full height of a cavity 4 passing through the entire height of the hull of the floating support;

said turret 2 is rotatably mounted relative to said hull by means of three rolling bearings $\mathbf{5}_1$, $\mathbf{5}_2$, $\mathbf{5}_3$, as described below, enabling said floating support to turn about a vertical axis ZZ' of said turret and of said cavity without causing said mooring buoy to turn; and said mooring buoy enables the underwater top ends of the first bottom-to-surface connection pipes 14 to be connected to the bottom ends of second pipes 14*c* rising within the cavity 4 up to a rotary joint coupling 3 located level with the deck 10.sub.1 of the hull at the top end of a central pillar of a carrier structure 6 supporting the pipe sections 14*c* that provide the connection between the bottom wall 2*c* of the turret and the rotary joint coupling 3.

Pipes 14*c* pass through the bottom wall 2*c* of the turret from a female portion 7*b* of the automatic connector under the bottom wall 2*c* at the bottom ends of the second pipes. These automatic connector female portions 7*b* co-operate with automatic connector male portions 7*a* at the top ends of the first pipes 14 carried by and moored to said buoy 1, thereby enabling the first and second pipes to be connected together.

The top portion of the mooring buoy 1 is constituted by a top tubular wall 1*a*, preferably of circular section, defining a chamber 30 containing the top ends of the first pipes 14 passing through the bottom 30*a* of the chamber 30, said top ends of the first pipes 14 and the bottom ends of the second pipes 14*c* being fitted with respective valves 8*a* and 8*b* and with the male portions 7*a* and the female portions 7*b* respectively of the automatic connectors 7. An annular gasket is applied against the top edge 1*b* constituting the edge face of the top tubular wall 1*a* of the mooring buoy 1.

The valves 8*a* and the male portions 7*a* of the automatic connectors 7 at the top ends of the first pipes 14 are supported by the bottom 30*a* of the valve chamber 30.

The valves 8*b* and the female portions 7*b* of the automatic connectors 7 at the bottom ends of the second pipes 14*c* are supported by the bottom wall 2*c* of the turret.

The mooring buoy 1 has a bottom portion 1*c* forming an annular box constituting a float under the bottom wall 30*a* of the valve chamber 30.

In known manner, the rotary joint coupling 3 is mounted to be free to rotate so as to allow said floating support to turn, without turning said coupling and the pipes that are connected thereto at the floating support.

Figure 2A:
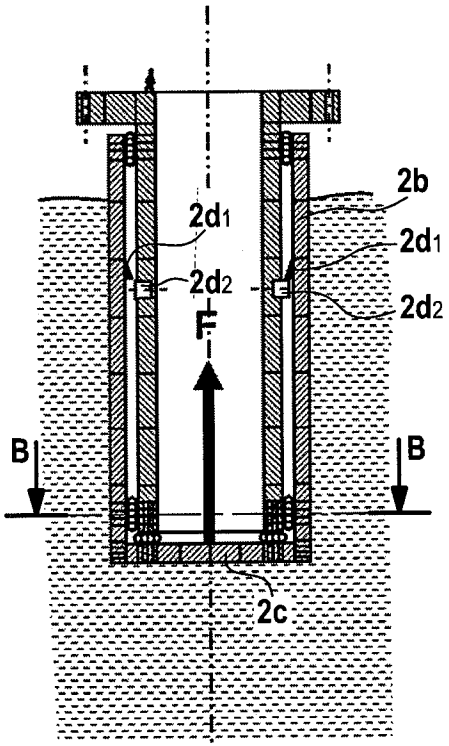
FIG. 2A is a section view of the turret subjected to buoyancy thrust.
Figure 2:
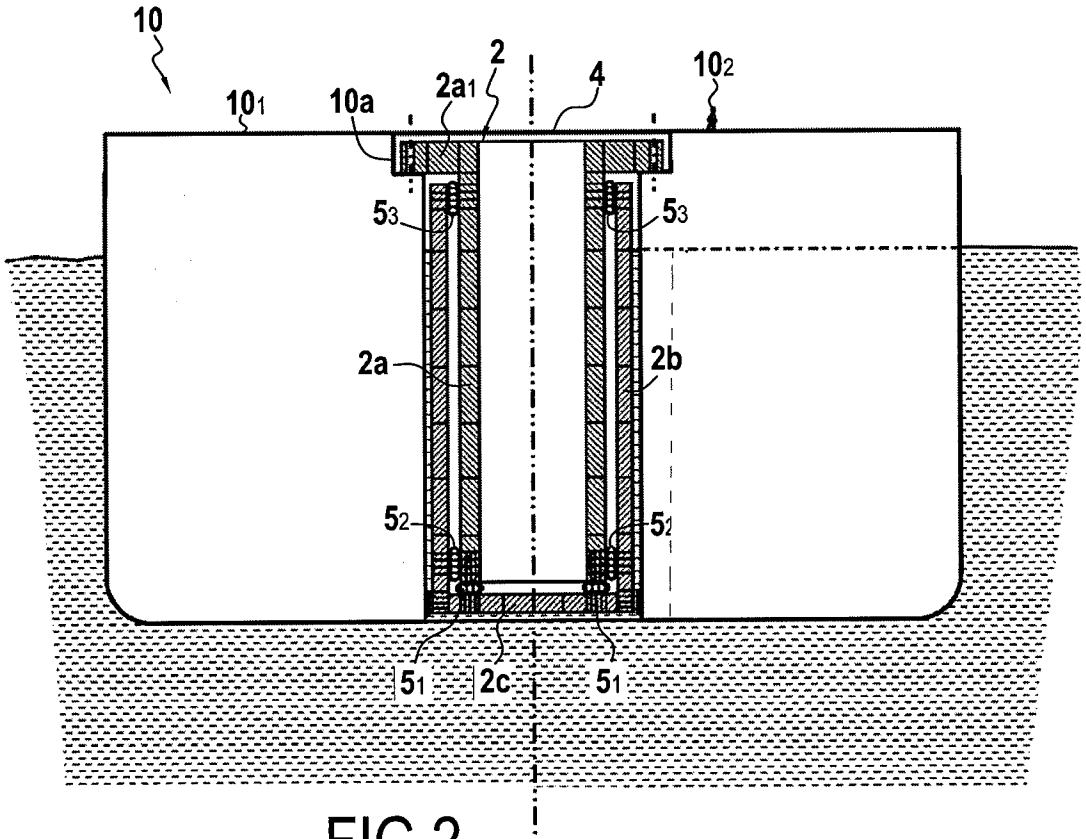
FIG. 2 is a section view on plane AA of FIG. 1 showing the FPSO and the turret of the invention in section, without showing said mooring buoy (1) nor the rotary joint coupling (3) at the deck of the hull.
Figure 2B:
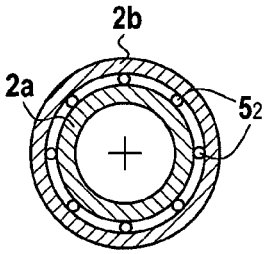
FIG. 2B is a section view on BB of FIG. 2A through a bottom rolling bearing.
Figure 2C:
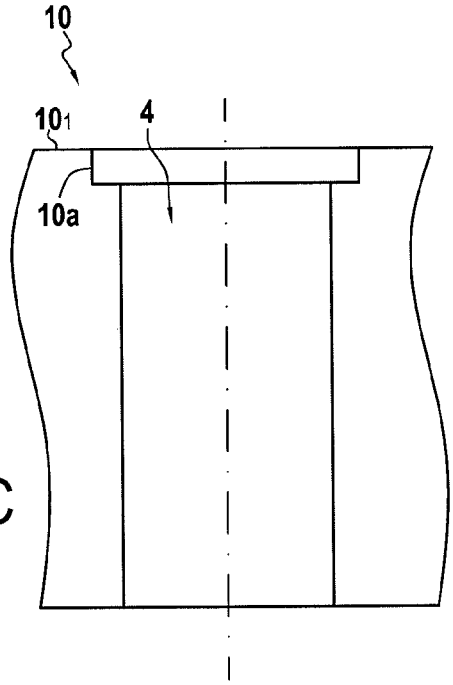
FIG. 2C is a section view of the FPSO showing its cavity that receives the turret.
Figure 2D:
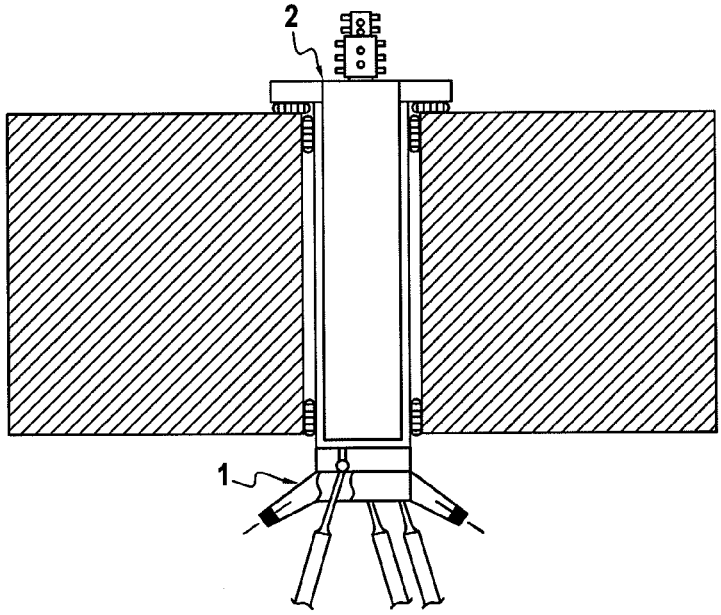
FIG.2D PRIOR ART
FIG. 2D is a diagrammatic section view of a prior art turret.

FIG. 2 is a side view in section shown the FPSO in section on plane AA of FIG. 1. The turret 2 is installed in a preferably circular cavity 4 passing vertically through the entire height of the FPSO 10, from its deck $\mathbf{10}_1$ down to the bottom of its hull. The top portion of the cavity 4 presents a step 10*a* matching the top portion $\mathbf{2}a_1$ of the turret. Sea water is present inside said cavity 4 of the FPSO and the turret naturally floats in said cavity since buoyancy thrust acts on an external structure 2*b* of the turret 2.

To clarify the figures, the guide and support bearings are shown as being constituted by rollers that are in contact on one side with the outer structure 2*b* and on the other with the inner structure 2*a*, however it is advantageous to use devices having wheels turning about axles, said wheels coming directly into contact with one of the structures, e.g. the outer structure 2*b*, and the axles of the said wheels being supported by the other structure, i.e. the inner structure 2*a*.

FIG. 2A is a side view in section showing the operation of the turret subjected to buoyancy thrust, and for greater clarity of explanation, the hull of the FPSO is omitted. The turret 2 is constituted by:

an internal structure 2*a* secured to the FPSO, having a peripheral plate $\mathbf{2}a_1$ at its top end that co-operates with the FPSO by bearing thereagainst and by being secured thereto, in particular by welding and/or by bolting, preferably at the level of the deck of said FPSO, and more particularly via a step 10*a* of said FPSO. The internal structure 2*a* is a tubular structure, preferably a substantially circular structure, and it extends over substantially the entire height of the turret; and a watertight tubular outer structure 2*b* that is preferably substantially circular, coaxial about the tubular inner structure 2*a*, and having a bottom 2*c* that is assembled in watertight manner to said outer structure 2*b*, said bottom having a plurality of pipes 14 passing therethrough in watertight manner.

For greater clarity, the figures show only one pipe 14 passing through the bottom 2*c*.

The internal structure may be a lattice-work structure constituted by an assembly of girders. The mooring system in the turret has three rolling bearings, namely:

a top bearing $\mathbf{5}_3$ for lateral guidance; and a bottom bearing $\mathbf{5}_2$ for lateral guidance; and a bottom bearing $\mathbf{5}_1$ for support.

Said bearings $\mathbf{5}_1$, $\mathbf{5}_2$, and $\mathbf{5}_3$ are friction bearings or rolling bearings, and they are preferably rolling bearings. More particularly, they may comprise rollers interposed between the inner structure 2*a* and the outer structure 2*b*, and they may be optionally be supported by the inside face of the outer structure 2*b* or by the outside face of the inner structure 2*a*.

It can be understood that at least at said bearings, said inner structure and said outer structure present sections that are circular. Said top and bottom bearings $\mathbf{5}_2$, $\mathbf{5}_3$ that provide lateral guidance are placed in the annular space between the outer and inner side surfaces of said inner and outer structures respectively, and they are preferably regularly spaced apart around the periphery in a circular configuration. The rollers of the bottom and top lateral guide bearings $\mathbf{5}_2$ and $\mathbf{5}_3$ are more particularly disposed with vertical axes. For the bottom support bearing $\mathbf{5}_1$, said rollers are disposed with horizontal axes. They are advantageously supported by the edge face of the inner structure at its bottom end.

Since the outer structure 2*b* is watertight, buoyancy thrust acts on the entire volume of displaced water, so said outer structure tends to rise towards the surface, however it then comes into contact via the bottom 2*c* with the bottom end of the tubular inner structure 2*a*, via a support bearing $\mathbf{5}_1$.

By way of example, in order to install a large number of pipes, for gas, for crude oil, for hydraulic umbilical connections, and for electrical cables, e.g. 36 or 48 pipes 14, all having their corresponding safety and control elements, the outside diameter of said outer structure 2*b* may exceed 25 m, and more particularly may be about 10 m to 20 m, and its wetted height is generally greater than 20 m, and may be as much as 25 m or even more when the hull of the floating support extends over a height of 50 m, as is sometimes the case. For an outer structure having a height of 20 m to 25 m and a diameter of 10 m to 20 m, this represents a vertical buoyancy thrust F of the order of 8000 metric tonnes (t) to 12,000 t. This considerable, upwardly-directed vertical force is transmitted to the inner structure 2*a* via the bottom support bearing 5.sub.1, and then to the hull of the FPSO via the peripheral plate 2*a*.sub.1 secured to said FPSO in the step 1*a*.

The inner and outer tubular structures have a common substantially vertical axis of rotation ZZ defined by the lateral guide bearings $\mathbf{5}_2$, $\mathbf{5}_3$, thereby enabling the FPSO to turn freely about said axis ZZ even though the annular mooring buoy 1 secured to the outer structure 2*b* presents an orientation relative to said axis ZZ that is substantially stationary relative to the sea bed.

The top and bottom lateral guide bearings $\mathbf{5}_3$ and $\mathbf{5}_2$ then enable the FPSO to turn about the substantially vertical axis ZZ with minimal friction and wear when the FPSO is subjected to horizontal forces due to pack ice, swell, wind, or even current.

Compared to the prior art, this disposition is advantageous since the means for guiding the turret in the bottom portion of the FPSO are not in contact with sea water, but are in the dry and are therefore accessible from inside the structure. The running tracks can thus be maintained and greased regularly, thereby greatly reducing friction and facilitating turning of the FPSO on its turret. In addition, individual bearing elements can easily be changed at any time. Naturally, these maintenance operations are preferably carried out in calm weather, after taking care to block rotation of the turret temporarily by means that are not shown.

Buoyancy thrust thus naturally holds the inner and outer structures 2*a* and 2*b* of the turret 2 in position, however a safety device is advantageously added in order to avoid the outer structure 2*b* dropping downwards, e.g. in the event of the turret becoming filled with water as a result of a valve breaking or of a leak through the watertight structure of said outer structure 2*b*. For this purpose, a series of abutments and catches $\mathbf{2}d_1$-$\mathbf{2}d_2$ are arranged in circular manner between said outer structure and said inner structure to prevent said outer structure from dropping downwards if it becomes flooded. For example, an abutment $\mathbf{2}d_1$ is fastened to the outer portion of the structure 2*b*, while a catch $\mathbf{2}d_2$ is movable in horizontal translation and is located within the inner structure 2*a* below the corresponding abutment $\mathbf{2}d_1$. Said catch $\mathbf{2}d_2$ is shown in a retracted position in the left-hand portion of FIG. 2A and in a deployed position for retaining the abutment $\mathbf{2}d_1$ in the right-hand portion of FIG. 2A in the event of the outer structure 2*b* having a tendency to sink. A similar catch is advantageously used to prevent the turret from turning during maintenance operations.

When the ship is highly stressed, whether by pack ice or by swell, wind, or current, its anchor system connected to the annular mooring buoy 1 holds it in position. Given the large dimensions of the FPSO, the reaction forces on the anchoring give rise to considerable variations in horizontal tension H, which may be as great as 5000 t to 7500 t in the event of pack ice advancing perpendicularly to the side of the FPSO, and as great at 1500 t to 3000 t under extreme conditions of swell, wind, and current. These horizontal forces are transmitted to the annular mooring buoy.

FIGS. 3A and 3B show a carrier structure in the form of a central pillar of circular section 6 resting on the bottom 2*c* of the outer structure 2*b* of the turret and serving both to support the pipes 14 passing through the cavity 4 in order to reach the rotary joint coupling 3, and also to support the rotary joint coupling 3 itself at its top, substantially level with the deck of the floating support 10.

The invention is described above with a support bearing $\mathbf{5}_1$ situated between the bottom of the inner structure 2*a* and the bottom of the watertight outer structure 2*b*, however, in a variant of the invention, said support bearing is situated at the top of the watertight outer structure 2*b*, between the outer structure and the inner structure, level with the underface of the peripheral plate $\mathbf{2}a_1$.

The invention claimed is:

1. An oil production floating support including a disconnectable mooring system for anchor lines anchored to the sea bottom and for bottom-to-surface connection pipes, the floating support comprising:

a mooring buoy for said anchor lines and first bottom-to-surface connection pipes extending from said buoy, to which they are moored, down to the bottom of the sea;

a turret extending in a through cavity passing along the entire height of the hull of the floating support, said mooring buoy being fastened under the hull of the floating support to said turret, said turret co-operating with the hull within said through cavity passing along the entire height of the hull of the floating support, said turret being rotatably mounted relative to said hull via at least one rolling or friction bearing, so as to allow said floating support to turn about a substantially vertical axis ZZ' of said turret and of said cavity without causing said mooring buoy to turn relative to the vertical axis ZZ'; and second connection pipes between the top ends of said first bottom-to-surface connection pipes and the deck of the floating support, the second pipes rising within the cavity to a coupling for a plurality of said second pipes, said coupling being secured to the floating support, said coupling being of the rotary joint coupling type and being rotatably mounted so as to allow said floating support to turn without turning said coupling;

the turret further comprising:

a watertight tubular outer structure about the vertical axis ZZ', having a bottom wall assembled in watertight manner to the bottom end of said watertight tubular outer structure;

said tubular outer structure containing an inner structure coaxial with said tubular outer structure, the top end of said inner structure being secured to the hull;

said bottom wall of the watertight outer structure having a plurality of said first connection pipes passing therethrough in leaktight manner, said first connection pipes passing through and supported by said inner structure;

said watertight outer structure not being supported by said hull nor being fastened to said hull, and having dimensions that enable it to float naturally in the water in the cavity in said floating support;

said inner and outer tubular structures co-operating with at least one bottom rolling or friction bearing, allowing said inner structure to turn, said outer structure being prevented from turning when said floating support is caused to turn about said vertical axis ZZ' of the cavity and of said watertight tubular outer structure; and said bottom rolling or friction bearing being situated below the surface of the water but inside said watertight outer structure.

2. The floating support according to claim 1, wherein at least one support bottom rolling bearing interposed between the bottom wall of said watertight tubular outer structure and the bottom end of said inner structure.

3. The floating support according to claim 1, wherein:

at least one bottom guide lateral rolling bearing interposed between the inner side surface of said outer tubular structure and the outer side surface of said inner structure, said bottom lateral guide bearing being situated below the level of the water surface and closer to said bottom wall of said tubular outer structure than to the top end of said tubular outer structure; and at least one top guide lateral rolling bearing interposed between the inner side surface of the outer tubular structure and the outer surface of said inner structure, said bearing being situated closer to the top end of said tubular outer structure than to the bottom of said tubular outer structure.

4. The floating support according to claim 1, wherein said rolling bearing(s) is/are constituted by rollers or by wheels.

5. The floating support according to claim 4, wherein said rollers or wheels are disposed circularly around said inner structure in the annular space between said inner and outer structures.

6. The floating support according to claim 1, wherein said outer and inner tubular structures include abutment means and retaining means preventing said outer structure from sinking in the event of sea water accidentally flooding the inside of the outer tubular structure by loss of watertightness, said abutment means and retaining means enabling the outer structure to be retained by said inner structure.

7. The floating support according to claim 1, wherein inner structure includes at its top end a top peripheral plate via which said inner structure is secured to the hull of said floating support.

8. The floating support according to claim 7, wherein said top plate bears against a step in the top end of said cavity in such a manner that said top plate does not project above the level of the deck of the floating support.

9. The floating support according to claim 1, wherein said inner structure contains a carrier structure in the form of a central pillar of circular section that rests on the bottom wall of said tubular outer structure and that extends up to the level of the deck of the floating support, said carrier structure holding said second connection pipes passing through the inner structure in a supported position, and also supporting said rotary joint coupling resting on top of said carrier structure level with the deck of the floating support.

10. The floating support according to claim 1, wherein said buoy includes a top tubular wall, of circular section defining a "valve" chamber when the top edge of the tubular top wall of the buoy is pressed against the bottom wall of the turret, said valve chamber containing the top ends of said first connection pipes passing through the bottom wall of said valve chamber, the top ends of said first pipes being fitted with vales and/or with male or female automatic connector portions supported by said bottom wall of the valve chamber, and said buoy including in its bottom portion an annular box constituting a float under the bottom wall of the valve chamber.

* * * * *